US007273383B1

(12) United States Patent
Bennett

(10) Patent No.: US 7,273,383 B1
(45) Date of Patent: Sep. 25, 2007

(54) RJ45 DEBRIS COVER

(76) Inventor: Robert Bennett, 149 Cortelyoue Ave., 2-1, Staten Island, NY (US) 10312

( * ) Notice: Subject to any disclaimer, the term of this patent is extended or adjusted under 35 U.S.C. 154(b) by 0 days.

(21) Appl. No.: 11/260,541

(22) Filed: Oct. 28, 2005

Related U.S. Application Data

(60) Provisional application No. 60/630,654, filed on Nov. 26, 2004.

(51) Int. Cl.
*H01R 13/44* (2006.01)

(52) U.S. Cl. ..... 439/142; 439/136; 439/373

(58) Field of Classification Search ..... 439/135, 439/136, 140, 142, 373, 145; 174/66, 67
See application file for complete search history.

(56) References Cited

U.S. PATENT DOCUMENTS 5,161,988 A * 11/1992 Krupka ..... 439/136
5,308,253 A * 5/1994 Maki ..... 439/148
5,542,852 A * 8/1996 Hsueh ..... 439/135
5,675,126 A * 10/1997 Halvorsen ..... 174/67
5,813,873 A * 9/1998 McBain et al. ..... 439/145
5,928,023 A * 7/1999 Buckner et al. ..... 439/373
5,936,214 A * 8/1999 Phillips ..... 200/43.22
6,840,780 B1 * 1/2005 Antaya et al. ..... 439/78
7,004,786 B1 * 2/2006 Bloom et al. ..... 439/501
2005/0163959 A1 * 7/2005 Cross et al. ..... 428/40.1
2006/0026878 A1 * 2/2006 Slater ..... 40/634

* cited by examiner

*Primary Examiner*—Hien Vu
(74) *Attorney, Agent, or Firm*—Patent & Trademark Services, Inc.; Joseph H. McGlynn

(57) ABSTRACT

A cover for an RJ45 port. The cover would substantially seal the port against contamination but, through the use of a pre-formed tab, would allow insertion of a plug so the port could be used for its intended purpose.

5 Claims, 1 Drawing Sheet

RJ45 DEBRIS COVER

Applicant claims priority of Provisional application Ser. No. 60/630,654, filed Nov. 26, 2004.

BACKGROUND OF THE INVENTION

This invention relates, in general, to covers, and, in particular, to covers which keep debris out of a socket.

DESCRIPTION OF THE PRIOR ART

In the prior art various types of covers have been proposed. For example, U.S. Pat. No. 5,017,153 to Bowman discloses a membrane for a floor outlet with slits that allow the prongs of a plug to pass through into the outlet.

U.S. Pat. No. 6,309,247 to Wang discloses an RJ45 socket with a dust proof cover which lodges in the opening when a plug is not present.

U.S. Pat. No. 5,675,126 to Halvorsen discloses an outlet cover having a cover pivoted to the face of the outlet.

U.S. Pat. No. 5,342,995 to Comerci et al discloses a protective cover with an adhesive back and slits which allow plugs to be passed through the cover.

SUMMARY OF THE INVENTION

The present invention is directed to a cover for an RJ45 port. The cover would substantially seal the port against contamination but, through the use of a pre-formed tab, would allow insertion of a plug so the port could be used for its intended purpose.

It is an object of the present invention to provide a new and improved cover for RJ45 ports.

It is an object of the present invention to provide a new and improved cover for RJ45 ports that protects the ports from contamination.

It is an object of the present invention to provide a new and improved cover for RJ45 ports that can be easily changed to use the ports in a normal manner.

These and other objects and advantages of the present invention will be fully apparent from the following description, when taken in connection with the annexed drawings.

DESCRIPTION OF THE PREFERRED EMBODIMENT

Figure 1:
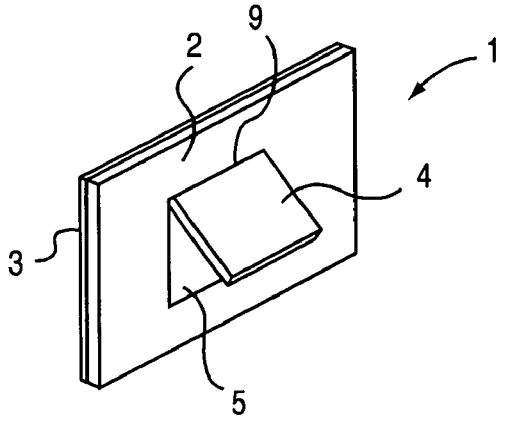
FIG. 1 is a perspective view of the present invention.

Referring now to the drawings in greater detail, FIG. 1 shows the cover 1 of the present invention. The cover is substantially rectangular, however, other shapes could be used without departing from the scope of the present invention. In addition, the cover is made from plastic and can be either transparent or made in a variety of colors. The cover

Figure 2:
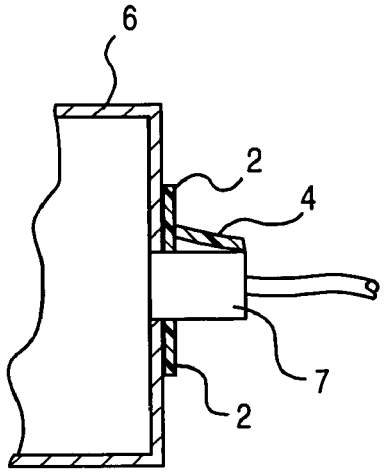
FIG. 2 is a partial sectional view of the present invention applied to a RJ45 socket.

1 has a body portion 2 with a length and a width forming a front surface and a back surface. The body has an adhesive layer 3 formed on the back surface. The adhesive layer 3 can be any conventional adhesive which will allow the cover 1 to be secured to an RJ45 port such as the port 6 shown in FIG. 2.

The cover body 2 has a flap 4 formed therein. The flap is at least partially severed from the body 2 on three sides and joined to the body by a "living hinge" 9. The hinge 9 allows the flap 4 to be pivoted up, as shown in FIG. 1, to revel an opening 5. The opening 5 is the area of the body 2 the flap is cut from. The opening 5 will allow an RJ45 plug (see 7 in FIG. 2) to be inserted through the opening 5 into an RJ45 port 6 once the flap 4 is lifted. When a RJ45 plug is not inserted in the port 6, the flap 4 will be pivoted down to cover the opening 5. This will cover the opening into the port 6 and keep dirt and other debris from entering the port. It should be noted that the hinge 9 is shown at the top of the flap 4, however, this is not essential and the hinge can be placed at any location that is convenient and will allow the device to operate in the intended manner.

Figure 3:
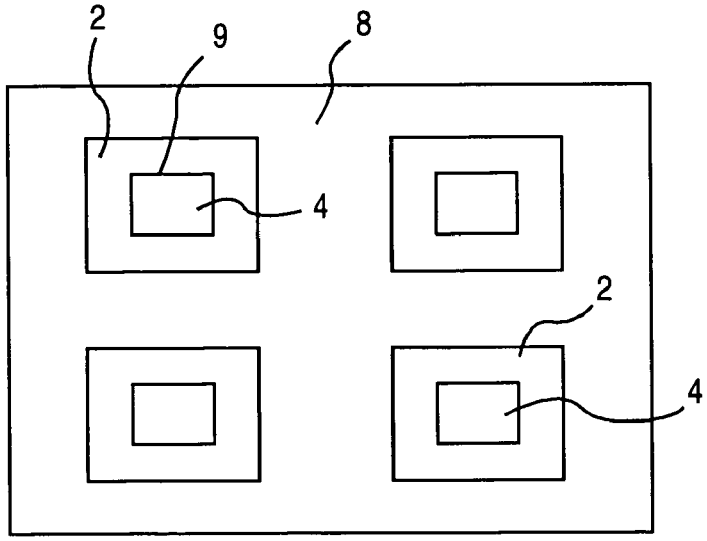
FIG. 3 is a plan view of a sheet containing a plurality of the covers of the present invention.

FIG. 3 shows a backing sheet 8 for transporting the covers and a plurality of the covers are secured to the sheet. The covers could be secured to the sheet 8 by the adhesive 3 on the back of the cover. The sheet 8 could be made from a material that would allow the covers to be easily peeled from the sheet. It should be noted the number of covers secured to the sheet 8 is shown as four, however, this is merely for illustrational purposes. More or fewer covers could be used without departing from the scope of the invention. Also, the cover of the present invention has been described as being used with an RJ45 port, however, the cover could be used with other types of ports without departing from the scope of the invention. Also, all the covers on the sheet 8 do not have to be the same shape as shown. Different shaped covers could be applied to one sheet so a user could select the shape necessary for his/her application.

In order to use the present invention, a user would select one of the covers and peel it from the sheet 8. Next he/she would place the cover 1 over a port 6 covering the entrance to the port. The adhesive 3 would maintain the cover in place. When the user wants to use the port, he/she grabs the tab 4 and lifts it while inserting the plug 7 into the port.

When the user is finished, he/she will remove the plug 7 and allow the tab to return to covering the aperture.

Although the RJ45 Debris Cover and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A sheet for holding protective covers that are removed from the sheet and being attached to ports of electrical sockets for covering and protecting the ports from debris, said sheet comprising:

a length and a width, a front surface, a back surface and the protective covers, each of said protective covers comprising:

a body portion, said body portion having a length and a width, a front surface and a back surface and can be removed from said sheet, means on said back surface of said body portion for securing said body to said sheet and removable from said sheet so that said body portion can be secured to another surface of one of the ports, means extending through each said body portion from said front surface to said back surface of said body portion for allowing access to said another surface from said front surface of said body portion, and means for closing said means extending through said body portion, wherein said means on said back surface for securing each said body portion to another surface is an adhesive.

2. The protective cover as claimed in claim 1, wherein said means extending through each said body from said front surface to said back surface of said body is an aperture.

3. The protective cover as claimed in claim 1, wherein said means for closing said means extending through each said body is a flap.

4. The protective cover as claimed in claim 3, wherein said flap is joined to said front surface of each said body on three sides.

5. The protective cover as claimed in claim 3, wherein said flap is unitary with each said body.

* * * * *